US005921800A

United States Patent [19]

Liebich

[11] Patent Number: 5,921,800

[45] Date of Patent: Jul. 13, 1999

[54] FIRING-CAP PLUG CONNECTOR

[75] Inventor: Ernst Liebich, Geltendorf, Germany

[73] Assignee: Siemens Aktiengesellschaft, Munich, Germany

[21] Appl. No.: 08/890,259

[22] Filed: Jul. 9, 1997

[30] Foreign Application Priority Data

Jul. 9, 1996 [DE] Germany ..... 196 27 635

[51] Int. Cl.[6] ..... H01R 13/627

[52] U.S. Cl. ..... 439/354; 439/466

[58] Field of Search ..... 439/354, 466, 439/936, 736, 604, 404, 400, 731, 687

[56] References Cited

U.S. PATENT DOCUMENTS

| | | | |
|---|---|---|---|
| 5,061,203 | 10/1991 | Allgood | 439/404 |
| 5,567,175 | 10/1996 | Warden | 439/736 |
| 5,795,170 | 10/1996 | Okabe | 439/936 |
| 5,796,039 | 9/1996 | Daoud | 439/936 |

FOREIGN PATENT DOCUMENTS

| | | |
|---|---|---|
| 0512682A2 | 11/1992 | European Pat. Off. . |
| 0698947A2 | 2/1996 | European Pat. Off. . |
| 4038756C1 | 4/1992 | Germany . |
| 4439786A1 | 5/1996 | Germany . |

*Primary Examiner*—Steven L. Stephan
*Assistant Examiner*—Javaid Nasri
*Attorney, Agent, or Firm*—Herbert L. Lerner; Laurence A. Greenberg

[57] ABSTRACT

A firing-cap plug connector for a collision safety device, in particular in vehicles, includes a plug having a housing with a lower housing component and an upper housing component. A contact chamber is provided for the connection of a clamping contact to connecting lines disposed perpendicularly thereto, through the use of insulation piercing devices. The contact chamber is surrounded by a flow duct configuration which is completely filled with an elastic sealing compound in a pressurized manner from the outside of the housing through an injection opening, in order to seal the contact chamber at a dividing gap between the upper housing component and the lower housing component.

11 Claims, 5 Drawing Sheets

FIRING-CAP PLUG CONNECTOR

BACKGROUND OF THE INVENTION

Field of the Invention

The invention relates to a firing-cap plug connector for a collision safety device, in particular in vehicles, including a plug connected to connecting lines and a female connector inserted into a housing wall of the collision safety device and having connecting plugs of a firing cap. The plug has a tubular plug component aligned perpendicu-larly to the connecting lines with sockets and a common holder for the plug component and the connecting lines. A plug connector device on one hand prevents incorrect insertion of the plug into the female connector, and on the other hand secures the plug in the female connector when a plug connection is being made.

Such firing-cap plug connectors which are used in particular in automotive electronics for airbag gas generators are known, for example, from Published European Patent Application 0 512 682 A2. In that case, the connection between the female connectors and the connecting lines which are aligned perpendicularly thereto is made by welding, soldering or crimp sleeves. The female connectors, including the connecting lines connected thereto, are then introduced into an injection mold together with further plug components made of metal or plastic, an elastomer sealing compound is partially injected between them at that location and they are provided with a casing which definitively determines the shape of the plug and seals the plug. In that case, particular measures must be taken to ensure that the sealing compound does not also get into sprung sockets to a certain extent, because otherwise the connection which is to be made between them and the firing cap can no longer be ensured in all cases.

SUMMARY OF THE INVENTION

It is accordingly an object of the invention to provide a firing-cap plug connector, which overcomes the hereinafore-mentioned disadvantages of the heretofore-known devices of this general type and which not only permits a simple and rapid assembly of the plug but also permits stringent requirements which are to be made of it in terms of tightness to be met in a simple and cost-saving manner.

With the foregoing and other objects in view there is provided, in accordance with the invention, a firing-cap plug connector for a collision safety device, in particular in vehicles, comprising a collision safety device housing wall; a female connector inserted into the collision safety device housing wall and having firing cap connecting plugs; a plug to be connected to connecting lines; and a device for preventing incorrect insertion of the plug into the female connector and for securing the plug in the female connector upon making a plug connection; the plug having a tubular plug component and a common holder housing for the plug component and the connecting lines, the common holder housing including a lower housing component and an upper housing component, the housing components having chamber component walls with junctions, the tubular plug component formed on the lower housing component, aligned perpendicularly to the connecting lines and having sockets; the common holder housing having an interior with a contact chamber formed from parts of the lower housing component and the upper housing component, the contact chamber enclosed for connecting the connecting lines led into the contact chamber to the sockets of the plug component, the contact chamber having openings with sealing ribs for the connecting lines; a flow duct configuration surrounding the contact chamber; and an elastic sealing compound to be injected under pressure from outside the common holder housing through an injection opening in the common holder housing for completely filling the flow duct configuration to seal the contact chamber at the junctions of the chamber component walls.

The invention is based on the realization that the division of the housing into two halves enables the assembly of the plug to be significantly simplified. At the same time, despite the divided housing, the stringent requirements which are made in terms of tightness can be fulfilled in an extraordinarily advantageous manner by virtue of the fact that the housing is configured in the region of the connection of the clamping contacts to the connecting lines to form an inner, enclosed contact chamber which is surrounded by a flow duct configuration. The contact chamber can then be sealed quickly using simple measures by filling the flow duct configuration with an elastomer sealing compound.

In accordance with another feature of the invention, the common holder housing has a side lying opposite the injection opening, and the flow duct configuration has a filling monitoring opening toward the outside of the common holder housing on the opposite side.

In accordance with a further feature of the invention, the chamber component walls engage in one another conically forming narrow, deep dividing gaps and downwardly extended sealing edges, for preventing penetration of the sealing compound into the contact chamber when the flow duct configuration is completely filled.

In accordance with an added feature of the invention, the upper and lower housing components include external wall components having edges with a tongue and groove engagement when joined together, for preventing the sealing compound from flowing out of the common holder housing when the flow duct configuration is completely filled.

In accordance with an additional feature of the invention, the common holder housing has openings for the connecting lines with clamping ribs for tensile relief at locations where the connecting lines are led in, an elastic sealing compound securing device for a support sleeve sealingly enclosing the connecting lines, and a wall accommodating the injection opening for the flow duct configuration between the openings for the connecting lines.

In accordance with yet another feature of the invention, the tubular plug component has a free end leading into a plug-on collar, the plug-on collar has a contour depression plug-on collar contour with a bottom; the female connector has a contour elevation female connector contour complementary to the plug-on collar contour for ensuring an always satisfactory plug-in connection; the plug-on collar receives a plate-shaped elastomer seal matched to the contour of the plug-on collar; the bottom of the plug-on collar contour and the elastomer seal clear mutually flush holes for access of the firing cap connecting plugs of the female connector to the sockets in the tubular plug component; and the female connector contour has an end side sealingly pressing the elastomer seal against the plug-on collar contour, when the plug-in connection is made.

Normally, in the case of known firing-cap plugs, the connecting line is hardwired to the plug sockets. This may be disadvantageous if, for example, a control unit already specifies the connecting lines to which the plug is to be connected. In that case, the plug can only be connected to the prescribed connecting lines by using an intermediate terminal, although the terminal itself is undesirable.

In accordance with yet a further feature of the invention, the connection between the connecting lines and the sockets of the plug component, which have been replaced by clamping contacts, is made within the contact chamber through the use of insulation piercing devices. This provides the possibility of also easily and reliably connecting a firing cap plug in situ to connecting lines which are already present, when necessary. In this case, all that is necessary is to ensure that the insulation piercing device configuration with the clamping contacts is accommodated in a suitable way in one housing half and the connecting lines to be connected thereto are accommodated in a suitable way in the other housing half. When the two housing halves are joined together, the insulation piercing devices then automatically produce the desired connection between the clamping contacts and the connecting lines. Filling the flow duct configuration with an elastomer sealing compound in situ does not present any problems either.

In accordance with yet an added feature of the invention, the lower and upper housing components have latching elements assigned to one another for mutual latching at the external wall components.

In accordance with yet an additional feature of the invention, the latching elements include pre-latching elements and final latching elements, the pre-latching elements effect pre-latching in a first step when the lower and upper housing components are joined together for mutually aligning the housing components and for aligning the insulation piercing devices with the connecting lines, and the final latching elements simultaneously effect a final latching of the housing components and contact between the connecting lines and the clamping contacts using the insulation piercing devices in a second step.

In accordance with again another feature of the invention, there are provided clips securing the connecting lines within the contact chamber on the upper housing component.

In accordance with a concomitant feature of the invention, there is provided a ferrite chamber adjoining the contact chamber toward the connecting lines led into the plug, and a ferrite disposed in the ferrite chamber and having parallel drill holes for guiding through the led-in connecting lines. Other features which are considered as characteristic for the invention are set forth in the appended claims.

Although the invention is illustrated and described herein as embodied in a firing-cap plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
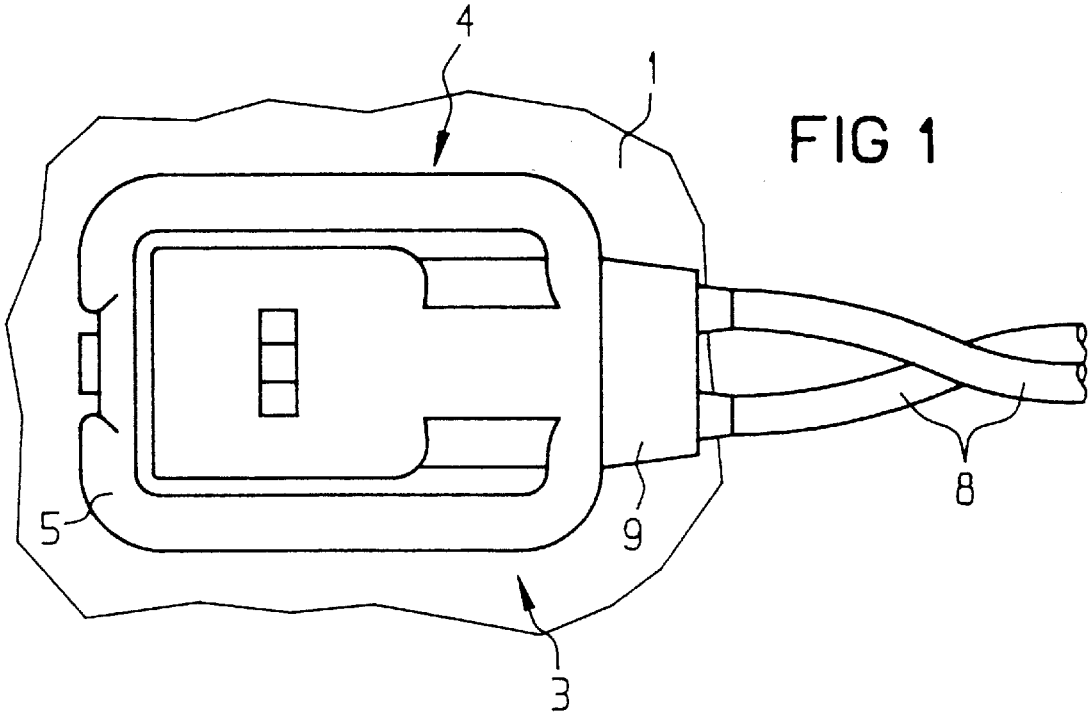
FIG. 1 is a fragmentary, diagrammatic, plan view of a firing-cap plug connector of a plug.

Referring now to the figures of the drawings in detail and first, particularly, to FIG. 1 thereof, there is seen a plan view of part of a housing wall 1 of a collision safety device with a firing-cap plug connector. A plug 3 or male connector has a housing 4 which includes an upper housing component 5, that can be seen from the outside in FIG. 1, and a lower housing component 6, which can likewise be seen from the outside in FIG. 2. The plug 3 is inserted into a receptacle or female connector, which cannot be seen in FIG. 1, but is illustrated in section in FIG. 5 and is designated there by reference numeral 2. As is shown in the side views of the housing 4 of the plug 3 in FIGS. 3 and 4, the housing 4 is in the form of a flat box and has a tubular plug component 7 on a lower surface thereof for engaging in the female connector 2. The plug component 7 is part of the lower housing component 6.

Figure 3:
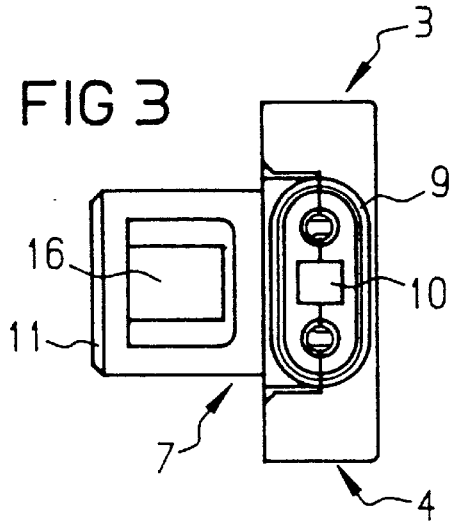
FIGS. 3 and 4 are side-elevational views of the plug.

Two connecting lines 8 leave the plug 3 from the right-hand narrow side of the housing 4. On this side, the housing 4 has a collar-shaped sleeve 9 which receives a non-illustrated support sleeve made of elastic material that surrounds the connecting lines 8 in a sealing manner. The housing 4 is a common holder for the plug component 7 and the connecting lines 8. The side view of the plug 3 in FIG. 3 shows a plan view of the sleeve 9 which illustrates that the common holder housing 4 has a rectangular opening between the connecting lines 8, specifically an injection opening 10 for the introduction of an elastic sealing compound, which is also illustrated in section in the sectional view in FIG. 7 and is designated there by reference numeral 45. During the execution of this injection procedure, which serves to seal the plug 3 on a contact side, the sleeve 9 is simultaneously filled with the sealing compound 45, and the aforesaid support sleeve is thus produced.

Figure 4:
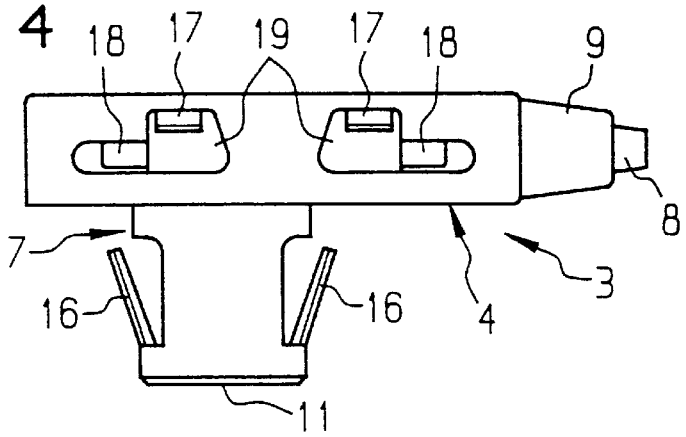
Figure 6:
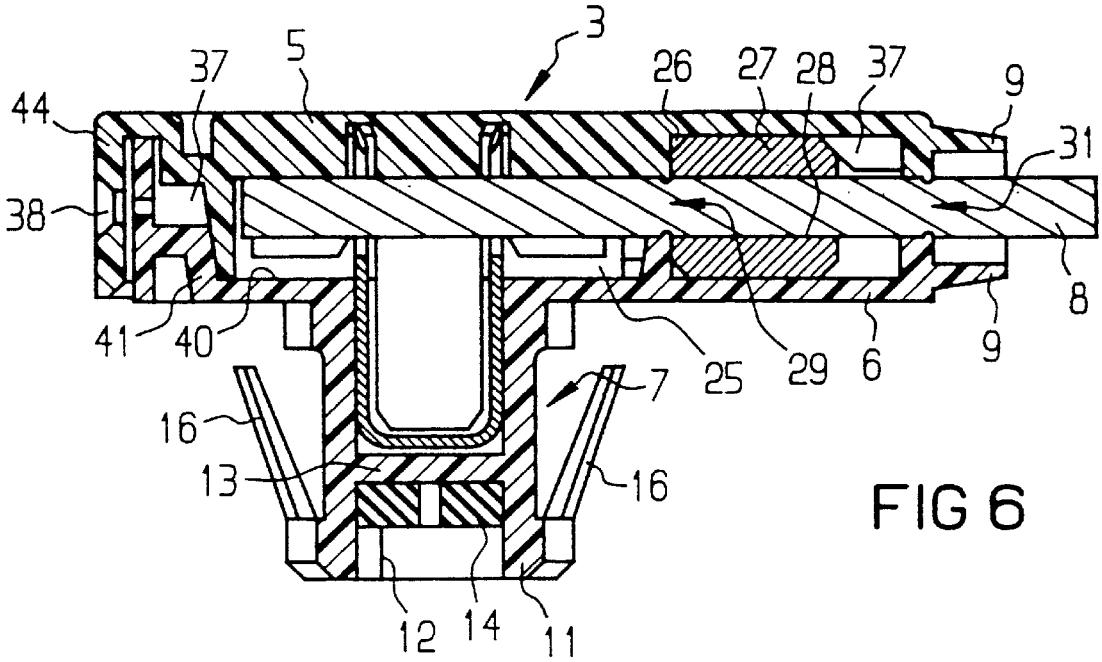
FIG. 6 is an enlarged, sectional view taken along a line VI/VII—VI/VII of FIG. 2, in the direction of the arrows, with a flow duct configuration which is still unfilled.
Figure 7:
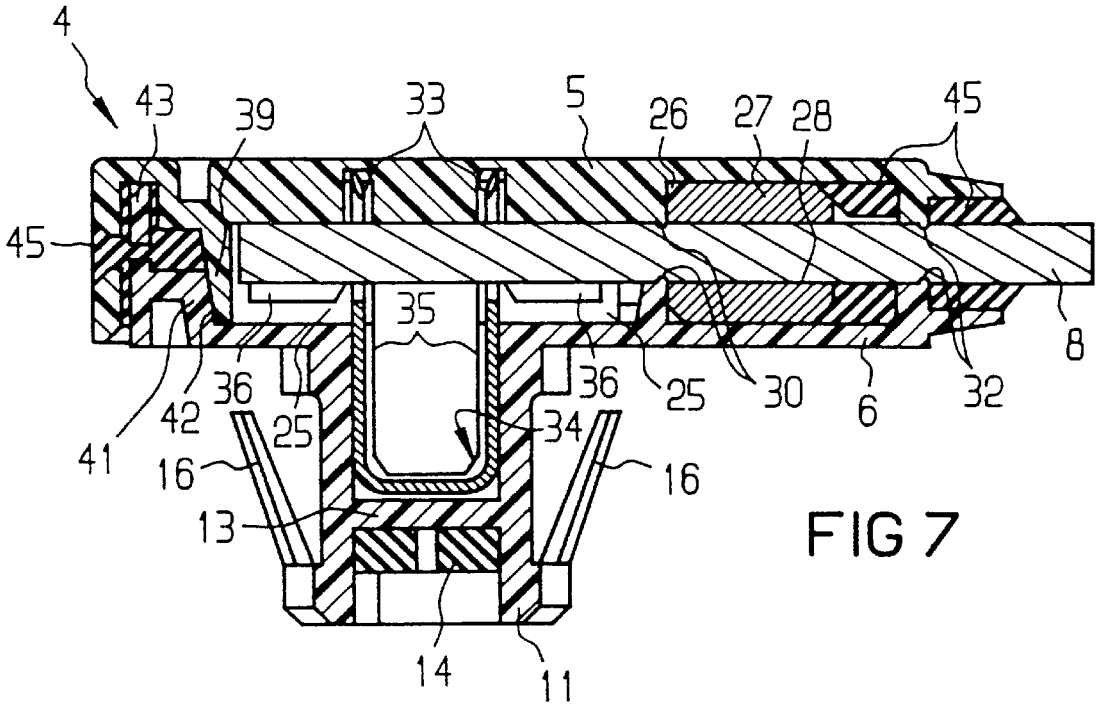
FIG. 7 is another enlarged, sectional view taken along the line VI/VII—VI/VII of FIG. 2, in the direction of the arrows, with a filled flow duct configuration.
Figure 8:
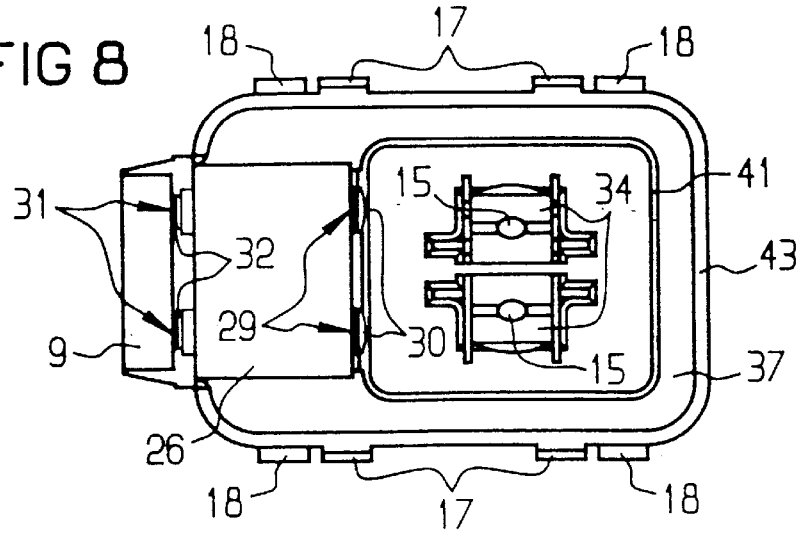
FIG. 8 is a plan view of the interior of a lower housing component of the plug.
Figure 9:
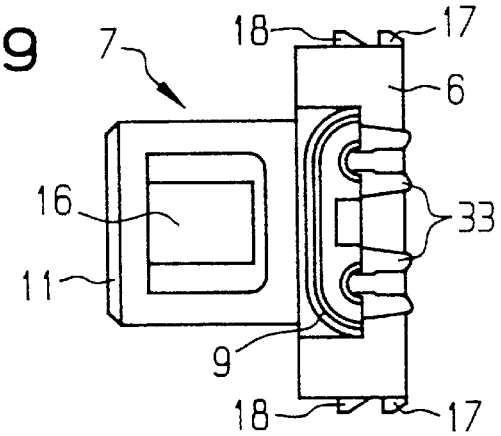
FIGS. 9 and 10 are side-elevational views of the lower housing component of the plug.
Figure 10:
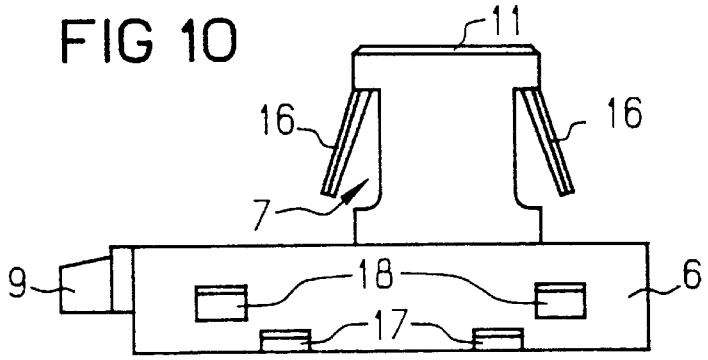
Figure 11:
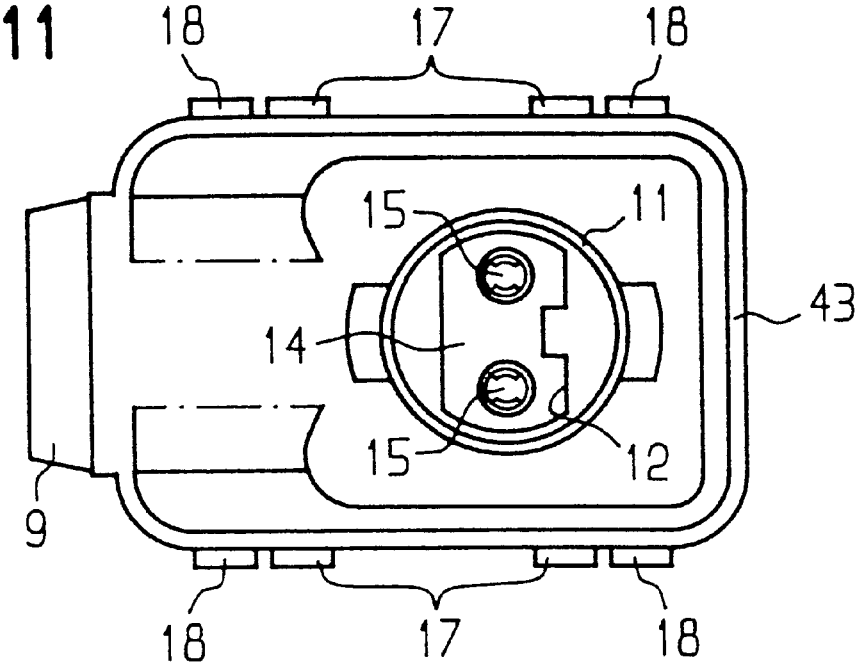
FIG. 11 is a plan view of the exterior of the lower housing component of the plug.

The tubular plug component 7 has a plug-on collar 11 at its free end. As is shown by the plan view of the lower surface of the housing 4 in FIG. 2, the plug-on collar 11 of the plug component 7 has a plug-on collar contour 12 in the form of a contour depression. As is seen in FIGS. 6 and 7, the plug-on collar contour 12 has a bottom 13 and a plate-shaped elastomer seal 14 which is fitted thereon and matched to the contour. The bottom 13 and the elastomer seal 14 have non-illustrated holes which are flush with one another and which clear access to clamping contacts 15 that are disposed in the tubular plug component 7. Furthermore, latching springs 16, which are aligned with their free ends sloping outward toward the housing 4 as is shown in FIG. 4, are mounted on opposite sides on the outside of the plug-on collar 11 of the tubular plug component 7.

Figure 5:
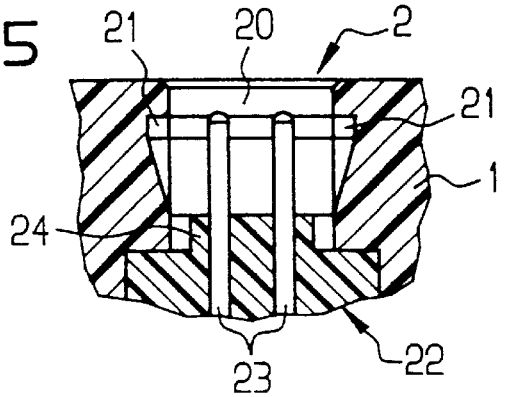
FIG. 5 is a fragmentary, sectional view of a female connector of the firing-cap plug connector, which female connector cannot be seen in FIG. 1.

The female connector 2, which is illustrated in section in FIG. 5 and is in the housing wall 1 of the collision safety device, includes a receptacle opening 20 which is matched to the outer contour of the tubular plug component 7, including the latching springs 16. An inner wall surface of the receptacle opening 20 has recesses 21 which are shaped in such a way as to form meeting elements for the latching springs 16. A base of the receptacle opening 20 of the female connector 2 is bounded by a base 22 of a firing cap with connecting plugs 23 which project into the receptacle opening 20. The base 22 of the firing cap has a contour elevation on the side where the connecting plugs 23 emerge. The contour elevation is provided by a female connector contour 24 which is complementary to the plug-on collar contour 12 of the plug component 7 and which ensures that the plug-in connection can be made only when there is correct poling between the connecting plugs 23 of the firing cap and the plug-side clamping contacts 15. When the plug-in connection is made, the elastomer seal 14 is pressed in a sealing manner against the plug-on collar contour 12 of the tubular plug component 7 by an end surface of the female connector contour 24. At the same time, the latching springs 16 engage in the receptacles 21 on the inner wall surfaces of the receptacle opening 20 and thus lock the plug-in connection which has been made.

Figure 2:
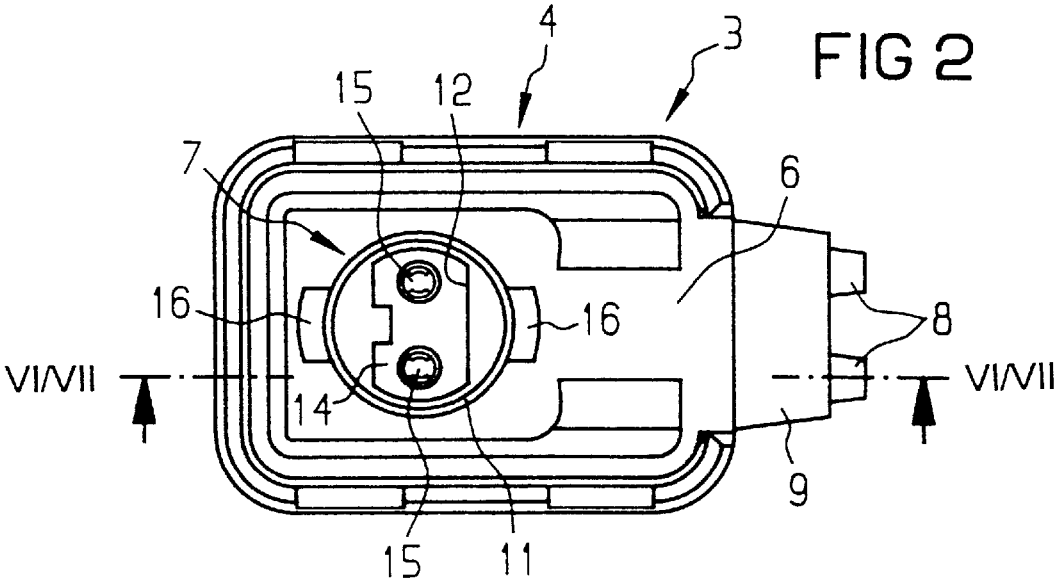
FIG. 2 is a bottom-plan view of the plug.
Figure 12:
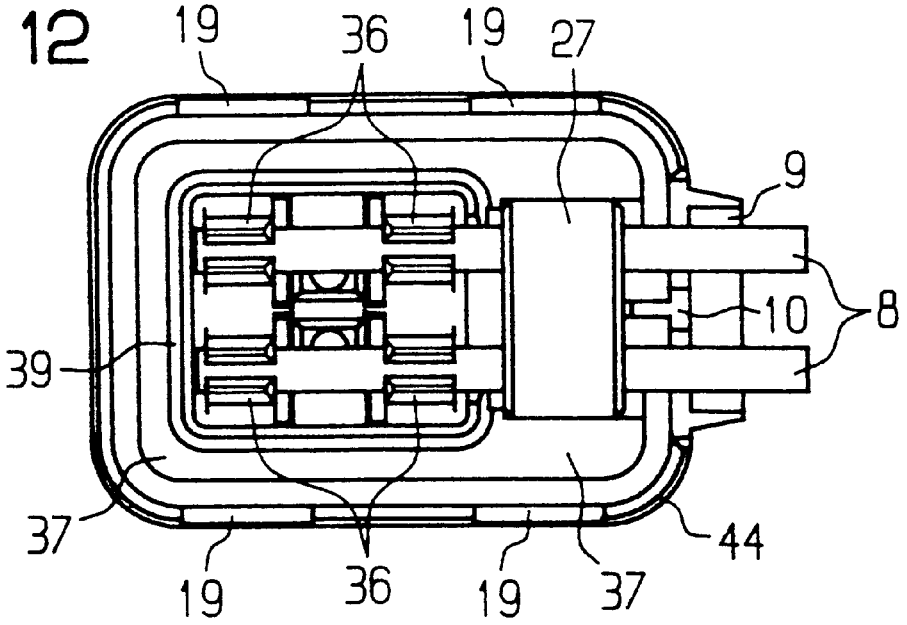
FIG. 12 is a plan view of the interior of an upper housing component of the plug.

A section of the plug 3 taken along a line VI/VII—VI/VII according to FIG. 2, which is illustrated in enlarged form both in FIG. 6 and in FIG. 7, makes it possible to see how the housing 4 including the upper housing component 5 and the lower housing component 6 is joined together. A comparison of FIGS. 6 and 7 makes it possible to see immediately that the two figures differ only in the sealing mass or compound 45 which is still absent in the view of the plug 3 in FIG. 6. The intention of this double view is to particularly emphasize the main feature of the invention in the drawings. Furthermore, this double view has the advantage of permitting the large number of reference numerals which have to be specified in the case of this sectional drawing for the sake of better clarity to be distributed over both FIGS. 6 and 7. In conjunction with the further description of the exemplary embodiment illustrated in the drawing with reference to FIGS. 6 and 7, details will simultaneously be given in FIGS. 8 to 12, of which FIGS. 8 to 11 represent different views of the lower housing component 6 and FIG. 12 shows an interior view of the upper housing component 5.

The upper housing component 5 and the lower housing component 6 are latched to one another in the state in which they are joined to form the housing 4. For this purpose, as is shown by FIGS. 8 to 11, the lower housing component 6 has two pre-latching elements 17 and two final latching elements 18 in the form of latching hooks on each of its two longitudinal sides. A common hole mating element 19 is provided on each of the two longitudinal sides of the upper housing component 6 for every pre-latching element 17 and every final latching element 18, as is shown by the side view of the plug 3 in FIG. 4.

As is shown particularly well by FIGS. 6 and 7, the housing 4 of the plug 3 has an enclosed contact chamber 25 in the vicinity of the tubular plug component 7. The contact chamber 25 is adjoined on the right, as an extension of the connecting lines 8, by a ferrite chamber 26 with a ferrite 27. The ferrite 27 has two drill holes 28 which are parallel to one another and through which the connecting lines 8 are led into the contact chamber 25. Openings 29 on the contact chamber side for leading the connecting lines 8 through are provided with sealing ribs 30 which press in a sealing manner into an insulating sheath of the connecting lines 8, when the two housing halves are locked together. In a corresponding way, openings 31 for leading the connecting lines 8 into the housing 4 are provided with clamping ribs 32 which provide tensile relief. The openings 29 and 31 with their sealing and clamping ribs 30 and 32 can be seen particularly well in the interior view of the lower housing component 6 in FIG. 8.

The electrically conductive connection between the clamping contacts 15 and the connecting lines 8 which are aligned perpendicularly thereto is brought about by using the insulation piercing principle, in the case of the plug 3. For this purpose, each of the two clamping contacts 15 is shaped, together with insulation piercing devices 33 assigned to it for connection to a connecting line 8, to form a sprung sheet-metal component 34 which can be inserted from the inside into the tubular plug component 7 of the lower housing component 6. As can be seen well in FIGS. 6 and 7, the sprung sheet-metal component 34 has two U legs 35 with free ends that are shaped to form an insulation piercing device 33. The clamping contact 15 which is connected to the two U legs 35 is provided in this case in a bridge part between the two U legs 35.

The ends of the connecting lines 8 which are led into the contact chamber 25 are attached on the inside to the upper housing component 5 in clips 36 outside the insulation piercing devices 33 of the U legs 35 of the sprung sheet-metal component 34, and are thus secured in their position with respect to the insulation piercing devices 33 of the sprung sheet-metal components 34 which are anchored in the lower housing compartment. As is shown by the interior view of the upper housing component 5 in FIG. 12, the ferrite 27 is also introduced into the upper housing component 5 before the housing halves are combined.

When the upper housing component 5 is joined to the lower housing component 6, the pre-latching elements 17 on the lower housing component 6 initially engage in the hole mating element 19 on the upper housing component 5, in a first step. This pre-latching merely serves to mutually align the housing components which are to be latched to one another, and thus also to perform precise mutual alignment of the insulation piercing devices 33 of the sprung sheet-metal components 34 with respect to the connecting lines 8 that are secured in the clips 36 in the upper housing component 5. In a subsequent, second step, in which the final latching of the two housing halves takes place, the final latching elements 18 on the lower housing component 6 also latch into the hole mating element 19 on the upper housing component 5. At the same time, the insulation piercing devices 33 cut through the insulating sheath of the connecting lines 8 and produce the desired conductive connection between the clamping contacts 15 and the connecting lines 8.

As has already been mentioned at the outset, the production of the connection between the clamping contacts 15 and the connecting lines 8 according to the insulation piercing principle has the great advantage of permitting the plug to also be easily connected in situ to connecting lines which have already been permanently specified, if necessary.

Due to the division of the housing 4 into two housing halves including the upper housing component 5 and the lower housing component 6, the contact chamber 25, which has an enclosed structure, and the ferrite chamber 26 of the housing 4, each include an upper chamber component and a lower chamber component. The stringent requirements which are usually made for the tightness of such plugs therefore require at least measures that ensure the tightness of the contact chamber 25. At the clamping contacts 15 which receive the connecting plugs 23 of the firing cap, the tightness which will be required is ensured by the plate-shaped elastomer seal 14 that is inserted into the plug-on collar contour 12 of the tubular plug component 7. At the insulation piercing connection, it is necessary to ensure that at least joints between chamber compartment walls 39 and 41 of the upper housing component 5 and the lower housing component 6 are sealed.

In order to seal the contact chamber 25, it is surrounded with an elastic sealing compound through the use of a flow duct configuration 37, as can be seen well in particular in FIGS. 6, 7, 8 and 12. In the state of the two housing halves in which they are combined with one another, the flow duct configuration 37 is open toward the injection opening 10 seen in FIGS. 3 and 12. As FIGS. 6 and 7 also show, the flow duct configuration 37 additionally has a filling monitoring opening 38 on the side of the housing 3 lying opposite the injection opening 10. In this way, when the flow duct configuration 37 is completely filled with the elastic sealing compound 45 in a pressurized manner, it is possible to easily check when the flow duct configuration 37 has been completely filled with the sealing compound.

In order to prevent the penetration of sealing compound into the contact chamber 25 when the flow duct configuration 37 is being filled, the height of the chamber component wall 39 of the upper housing component 5 is selected in such a way that it is supported at its end on a bottom 40 of the lower housing component 6. The lower housing component 6 also has a chamber component wall 41. However, the height of the chamber component wall 41 is substantially smaller than that of the chamber component wall 39. The two chamber component walls 39 and 41 engage in one another in the manner of two cones and, in doing so, form a relatively long and narrow dividing gap 42 which forms a flow resistance for the sealing compound that is penetrating it which it cannot overcome.

When the flow duct configuration 37 is completely filled with sealing compound, it is also necessary to prevent sealing compound from flowing out of the housing. For this purpose, in the exemplary embodiment which is shown in particular by FIGS. 6 and 7, there is a provision for external wall components 43 and 44 of the upper housing component 5 and lower housing component 6 to engage in one another in the manner of a "tongue and groove".

In conclusion, it is to be noted that known firing cap plugs accommodate the plug in sockets provided in the tubular plug component in small ferrite tubes in order to protect them against interference radiation. However, the high-frequency inductive damping which is caused thereby is restricted to narrow limits in that case due to the small space for the accommodation of the ferrite. If the ferrite is accommodated on the connecting line side inside the plug housing, that restriction is advantageously largely eliminated. If necessary, the plug can be configured in this case even for relatively large high-frequency inductive damping through the selection of the size of the ferrite.

If a firing-cap plug connector is not subjected to the weather and is not used in damp areas, that is to say the requirements in terms of the tightness of the plug do not apply, it is of course possible to dispense with complete filling of its flow duct configuration with an elastic sealing compound in order to save costs, especially since the mutual latching of the two housing halves is completely sufficient to hold the plug together.

I claim:

1. A firing-cap plug connector for a collision safety device, comprising:

a collision safety device housing wall;

a female connector inserted into said collision safety device housing wall and having firing cap connecting plugs;

a plug assembly to be connected to connecting lines; and a device for preventing incorrect insertion of said plug assembly into said female connector and for securing said plug assembly in said female connector upon making a plug connection;

said plug assembly having a tubular plug component and a common holder housing for said plug component and the connecting lines, said common holder housing including a lower housing component and an upper housing component, said housing components having chamber component walls with junctions, said tubular plug component formed on said lower housing component, aligned perpendicularly to the connecting lines and having contacts;

said common holder housing having an interior with a contact chamber formed from parts of said lower housing component and said upper housing component, said contact chamber enclosed for connecting the connecting lines led into said contact chamber to said contacts of said plug component, said contact chamber having openings with sealing ribs for the connecting lines;

a flow duct configuration surrounding said contact chamber; and an elastic sealing compound to be injected under pressure from outside said common holder housing through an injection opening in said common holder housing for completely filling said flow duct configuration to seal said contact chamber at said junctions of said chamber component walls.

2. The firing-cap plug connector according to claim 1, wherein said common holder housing has a side lying opposite said injection opening, and said flow duct configuration has a filling monitoring opening toward the outside of said common holder housing on said opposite side.

3. The firing-cap plug connector according to claim 1, wherein said chamber component walls engage in one another conically forming narrow, deep dividing gaps and downwardly extended sealing edges, for preventing penetration of said sealing compound into said contact chamber when said flow duct configuration is completely filled.

4. The firing-cap plug connector according to claim 1, wherein said upper and lower housing components include external wall components having edges for preventing said sealing compound from flowing out of said common holder housing when said flow duct configuration is completely filled.

5. The firing-cap plug connector according to claim 1, wherein said common holder housing has openings for the connecting lines with clamping ribs for tensile relief at locations where the connecting lines are led in, an elastic sealing compound securing device for a support sleeve sealingly enclosing the connecting lines, and a wall accommodating said injection opening for said flow duct configuration between said openings for the connecting lines.

6. The firing-cap plug connector according to claim 1, wherein:

said tubular plug component has a free end leading into a plug-on collar, said plug-on collar has a contour depression plug-on collar contour with a bottom;

said female connector has a contour elevation female connector contour complementary to said plug-on collar contour for ensuring an always satisfactory plug-in connection;

said plug-on collar receives a plate-shaped elastomer seal matched to the contour of said plug-on collar;

said bottom of said plug-on collar contour and said elastomer seal clear mutually flush holes for access of said firing cap connecting plugs of said female connector to said sockets in said tubular plug component; and said female connector contour has an end side sealingly pressing said elastomer seal against said plug-on collar contour, when the plug-in connection is made.

7. The firing-cap plug connector according to claim 1, including insulation piercing devices making a connection between the connecting lines and said contacts of said plug component inside said contact chamber, said contacts each being a clamping contact shaped together with said insulation piercing devices for connection to one of the connecting lines, to form a sprung sheet-metal component to be inserted into said tubular plug component.

8. The firing-cap plug connector according to claim 1, including clips securing the connecting lines within said contact chamber on said upper housing component.

9. The firing-cap plug connector according to claim 1, including a ferrite chamber adjoining said contact chamber toward the connecting lines led into said plug, and a ferrite disposed in said ferrite chamber and having parallel drill holes for guiding through the led-in connecting lines.

10. The firing-cap plug connector according to claim 7, wherein said upper and lower housing components include external wall components having edges for preventing said sealing compound from flowing out of said common holder housing when said flow duct configuration is completely filled, said lower and upper housing components have latching elements assigned to one another for mutual latching at said external wall components.

11. The firing-cap plug connector according to claim 10, wherein said latching elements include pre-latching elements and final latching elements, said pre-latching elements effect pre-latching in a first step when said lower and upper housing components are joined together for mutually aligning said housing components and for aligning said insulation piercing devices with the connecting lines, and said final latching elements simultaneously effect a final latching of said housing components and contact between the connecting lines and said clamping contacts using said insulation piercing devices in a second step.

* * * * *